United States Patent [19]

Gach

[11] 4,236,653

[45] Dec. 2, 1980

[54] CHILD-RESISTANT DISPENSING CLOSURE

[75] Inventor: Peter P. Gach, Evansville, Ind.

[73] Assignee: Sunbeam Plastics Corporation, Evansville, Ind.

[21] Appl. No.: 61,832

[22] Filed: Jul. 30, 1979

[51] Int. Cl.[3] ..... B65D 47/08

[52] U.S. Cl. ..... 222/153; 222/543; 222/556

[58] Field of Search ..... 222/153, 543, 517, 556, 222/562; 220/339; 215/201, 224

[56] References Cited

U.S. PATENT DOCUMENTS

| | | | |
|---|---|---|---|
| 1,794,987 | 3/1931 | Sebolt | 222/556 X |
| 3,059,816 | 10/1962 | Goldstein | 222/543 X |
| 3,240,405 | 3/1966 | Abbott | 222/543 |
| 3,441,161 | 4/1969 | Van Baarn | 215/40 |
| 3,542,235 | 11/1970 | Hidding | 220/339 |
| 3,741,447 | 6/1973 | Miles | 222/543 X |
| 3,752,371 | 8/1973 | Susuki et al. | 222/517 X |
| 3,853,250 | 12/1974 | Alpern | 222/517 |
| 4,010,875 | 3/1977 | Babiol | 222/517 |
| 4,158,902 | 6/1979 | Chernak et al. | 220/339 X |

FOREIGN PATENT DOCUMENTS

| | | | |
|---|---|---|---|
| 1228265 | 3/1960 | France | 220/339 |
| 600651 | 12/1959 | Italy | 220/339 |
| 1360091 | 7/1974 | United Kingdom | 220/339 |

*Primary Examiner*—Robert J. Spar
*Assistant Examiner*—Frederick R. Handren
*Attorney, Agent, or Firm*—Henry K. Leonard

[57] ABSTRACT

A child-resistant dispensing closure consisting of a one-piece molding of resilient material that comprises an inverted cup-shaped cap having a central dispensing opening and a saucer shaped lid that is integrally hinged to the cap at one edge thereof for movement to and from an inverted, closing position closely overlying the cap. The lid has an element which closes the dispensing opening and engages in telescoping relationship therewith. The cap and lid have overlapping catch means for retaining the lid in closing position. The hinge is double acting and provides not only for angular movement to and from the closing position but also for lateral movement of the lid relative to the cap against the resilience of the engaged element and opening for disengaging the catch means. In a preferred embodiment, the dispensing opening is in the upper end of a nozzle which is an integral part of the cap and the closing element is on the underside of the lid, so that it engages the upper end of the nozzle and closes the nozzle opening.

12 Claims, 18 Drawing Figures

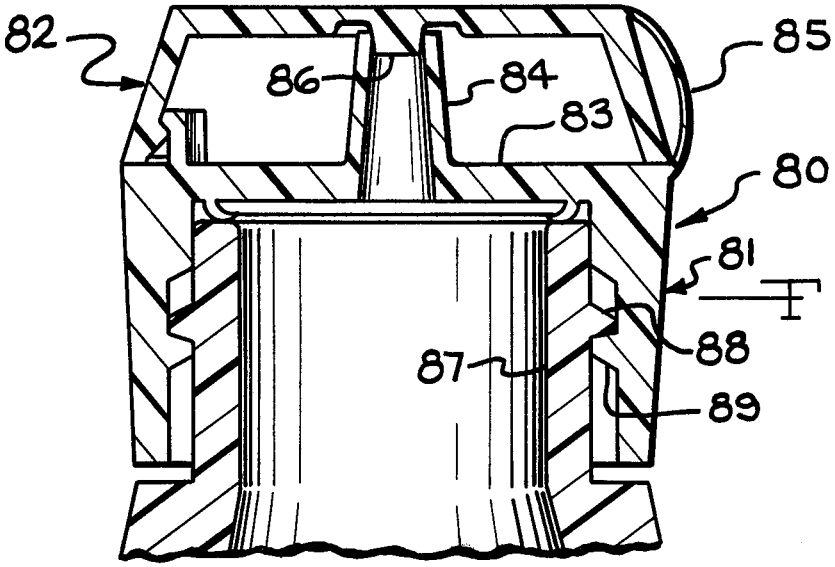
FIG. 16
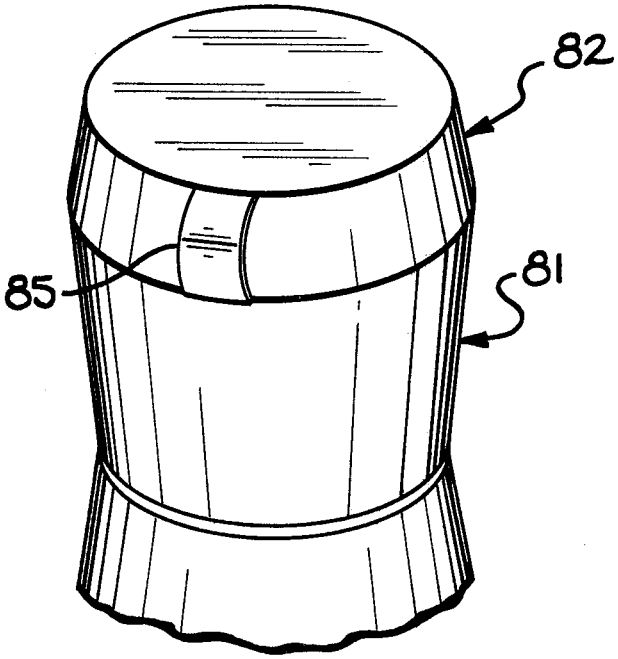
FIG. 17
FIG. 18
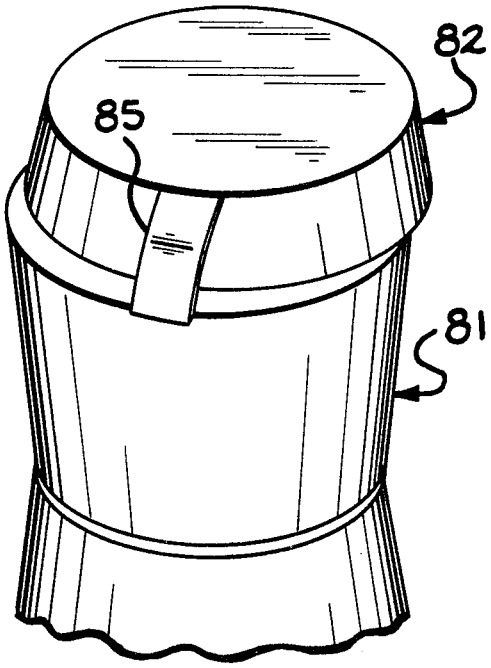

CHILD-RESISTANT DISPENSING CLOSURE

BACKGROUND OF THE INVENTION

Because of the fact that many substances found in an average home are extremely dangerous and often life threatening, particularly if consumed by a child of tender years, much emphasis has been placed on packaging many such substances in containers provided with child-resistant caps. For examples, many drugs, both prescription and over-the-counter, are so packaged, as are some dangerous liquid and particulate substances such as anit-freeze for automobiles, drain cleaners, furniture polishes, etc.

Most of the child-resistant caps which so far have been developed fall into either of two general classes. Some of the caps consist of two separate parts which must be assembled to each other before being placed upon the containers which they are to fit. Others have been so designed as to consist of only one integral or unitary piece, thus reducing the cost of manufacture by eliminating the necessity for a second mold and for an assembly task.

The most successful of the child-resistant closures usually have had two features in common. First, in order to remove or open the closure, it has been necessary that two separate and dissimilar movements or actions take place. It has been found that a child of tender years, say six or less, usually does not readily comprehend how these two dissimilar actions must be performed, although an older child or an adult can do so by reading the instructions which usually are printed or molded on the closures. Secondly, some of the most successful child-resistant closures have also had the property of clearly indicating to an observing adult whether or not the closure is in child-resistant status or merely has been returned to its container without being restored to protective condition.

Unfortunately, many other substances which commonly are found in domestic situations have not yet been provided with satisfactory child-resistant closures. For examples, toilet bowl cleaning liquids, dishwashing liquids, and others, which usually are packaged in containers having dispensing openings, still appear in the market place with closures which an average small child can readily open.

Some closures for such substances have been provided with what might be called "snap-caps," i.e., caps which require that they be removed by the exercise of a fairly substantial amount of force, as, for example, to lift one edge so that the closure can be opened. The cap disclosed in Babiol U.S. Pat. No. 4,010,875 would possess some child-resistant features simply by reason of the fact that a small amount of force is required to disengage the closing lid from the cap body so that it can be swung into open position and the content material dispensed from the container. However, it also has been found that where but a single movement is required, as in the Babiol closure, even a very small child readily can open the closure. In many cases, the child holds the container in one hand and bites into the cap, whereupon he possesses more than adequate strength to open the closure.

Many prior art child-resistant caps can be replaced upon their containers in what seems to be closed position without actually being re-established in child-resistant status. As a result, if the user is inattentive or a little bit careless, it may seem that the closure is safe although it really is not.

It is, therefore, the principal object of the invention to provide a child-resistant dispensing closure particularly designed to be utilized on containers of liquid materials which are dispensed in small quantities.

It is a second and equally important object of the instant invention to provide a child-resistant dispensing closure which positively indicates whether or not it is in protective status and which automatically returns to child-resistant status every time it is closed.

Yet another object of the instant invention is to provide a child-resistant dispensing closure which requires that two completely dissimilar actions be simultaneously performed in order to open the closure.

And yet another object of the instant invention is to provide a child-resistant dispensing closure having the foregoing features which readily can be manufactured as a single, unitary piece of resilient, resinous material such as polypropylene or the like, thus enabling high-speed production in multi-cavity molds in order to minimize cost. A further object of the instant invention is to provide a unitary child-resistant dispensing closure, the parts of which have exteriors so designed that the closures may be placed upon containers by the use of conventional automatic capping machines.

BRIEF DESCRIPTION OF DRAWINGS

FIG. 16 is a vertical, sectional view of yet another embodiment of the invention; and FIGS. 17 and 18 are perspective views of the embodiment of FIG. 16 which are comparable to FIGS. 1 and 2, respectively.

DESCRIPTION OF PREFERRED EMBODIMENTS

Figure 1:
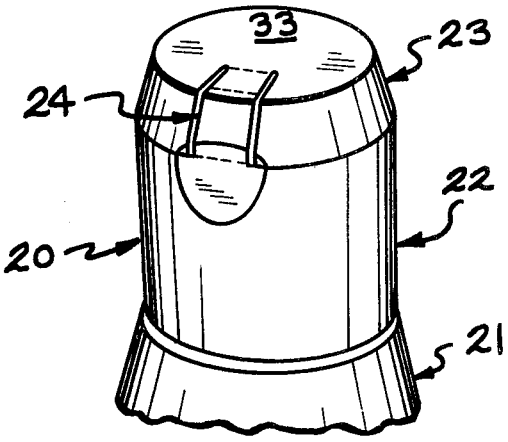
FIG. 1 is a fragmentary view in perspective, showing a child-resistant dispensing closure embodying the invention on the neck of a container, the closure being shown in closed position.
Figure 2:
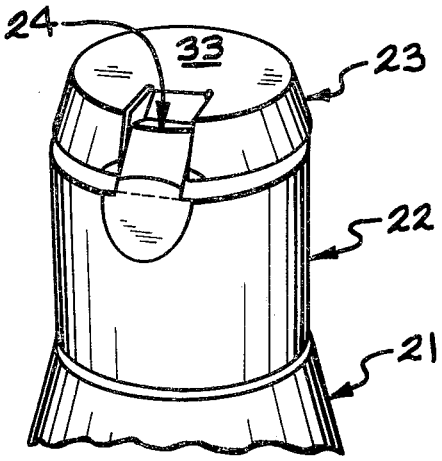
FIG. 2 is a view similar to FIG. 1, but illustrating a first movement which is necessary to open a closure embodying the invention.

A first embodiment of a child-resistant dispensing closure according to the invention is illustrated in FIG. 1–9, inclusive. The closure, generally indicated by the reference number 20, is a unitary structure and is shown in FIGS. 1–7, inclusive, as being in position on a container 21 which has a threaded neck.

The closure 20 comprises an inverted, cup-shaped cap 22 and a lid 23 which are hingedly connected to each other by a double-acting hinge, generally indicated by the reference number 24.

The cap 22 also has an inner, co-axial skirt 28 which is connected at its upper end to the upper end of the outer skirt 25 by an annular web 29. A lower, inwardly-directed web 30 is integral with the lower edge of the inner skirt 28, and its inner, circular edge defines an opening into the lower end of an axially extending nozzle 31, which is integral therewith. The nozzle 31 protrudes upwardly beyond the top web 29 and has a dispensing orifice 32 at its upper end.

The lid 23 has a disc-like top 33 and, in the illustrated embodiment, is generally saucer-shaped, having a conical rim 34. A nozzle closing element 35 is formed on the inner surface of the lid 33, as best can be seen in FIG. 5.

The lid 23 is integrally connected to the cap 22 by the double-acting hinge 24, which has two leaves 36 and 37. The hinge 24 is located in an inwardly-extending recess 38, formed partly in the top 33 of the lid 23 and in the rim 34 thereof. The hinge leaf 36 is connected to the edge of the cap 22 by a narrow, flexible web 39. The leaf 36 is connected to the leaf 37 and, in turn, the leaf 37 connected at its opposite side to the lid top 33 by thin, flexible portions 40 and 41.

Figure 3:
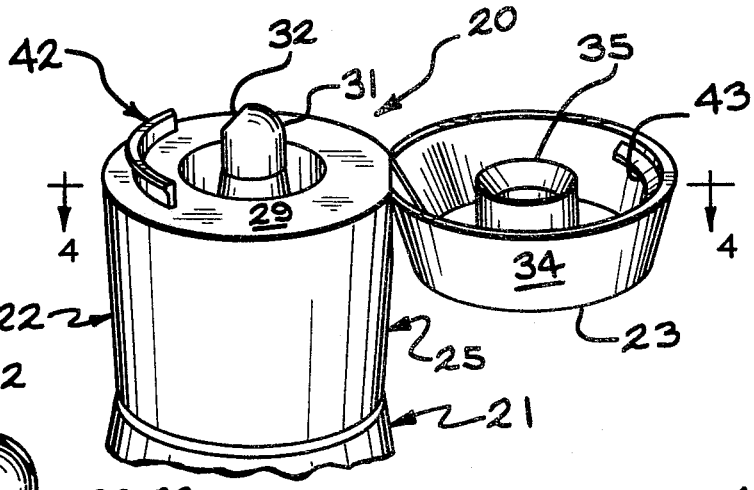
FIG. 3 is a view similar to FIGS. 1 and 2, with the closure rotated some 90°, more or less, and being illustrated in open position.
Figure 4:
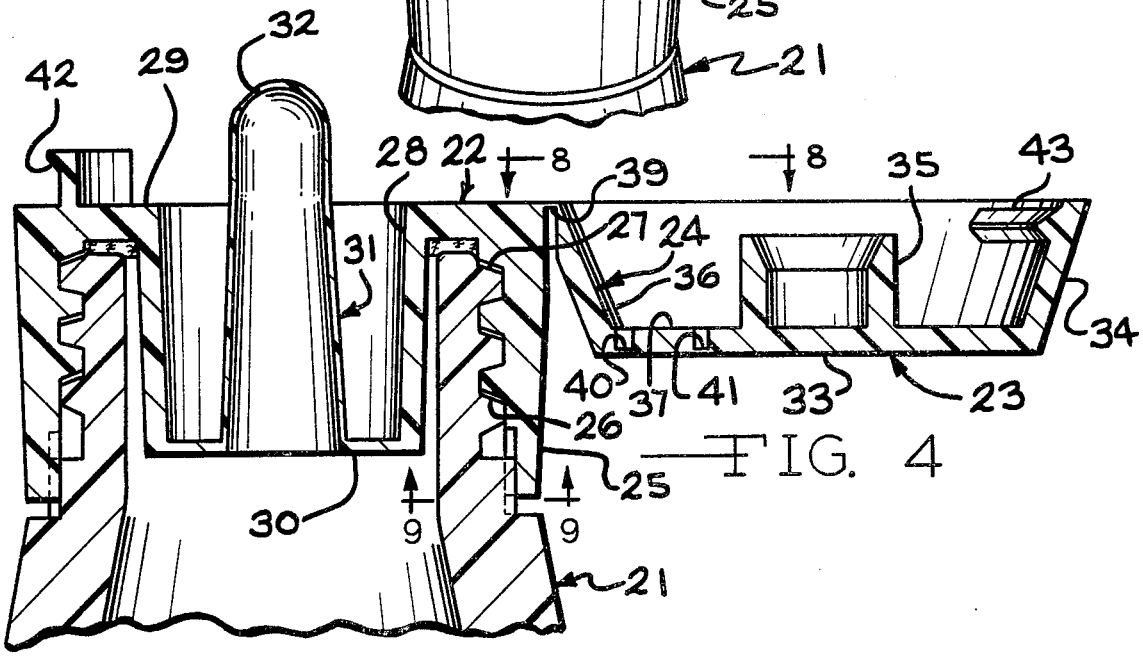
FIG. 4 is a diametric, vertical sectional view, taken generally along the line 4—4 of FIG. 3 and shown on a greatly enlarged scale.

Angular movement of the lid 23 from the fully open position illustrated in FIGS. 3 and 4 is accomplished by swinging the lid 23 over to a position above the cap 22, the web 39 providing for this movement.

Figure 5:
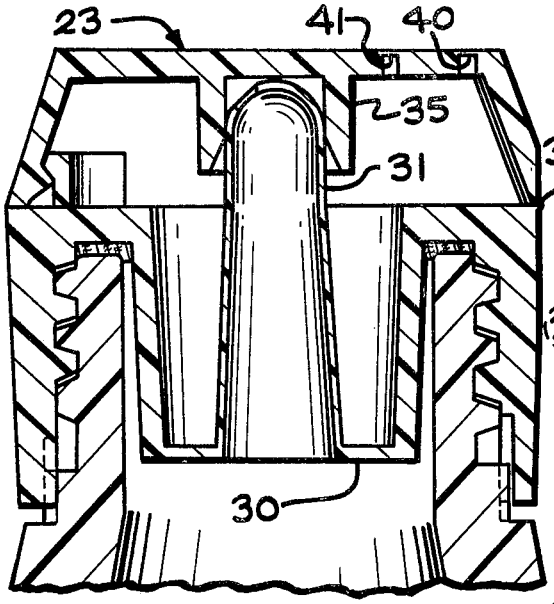
FIG. 5 is a view similar to FIG. 4, but showing the closure in closed position.
Figure 8:
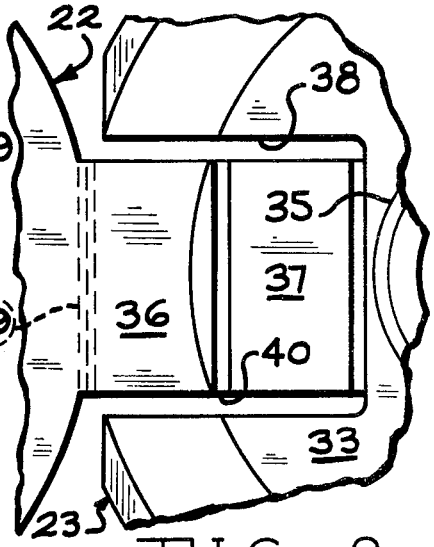
FIG. 8 is a fragmentary, top plan view taken from the position indicated by the line 8—8 of FIG. 4 and shown on a further enlarged scale.

When the lid 23 approaches the closed position of FIGS. 1 and 5, engagement takes place between lid catch means on the lid 23 and the cap 22. These catch means consist of an arcuate, over-hanging lip 42, erected above the top web 29 at the side opposite the hinge web 39, and an undercut, complementary rib on the inner side of the lid rim 34, which also is located opposite the web 39.

Figure 7:
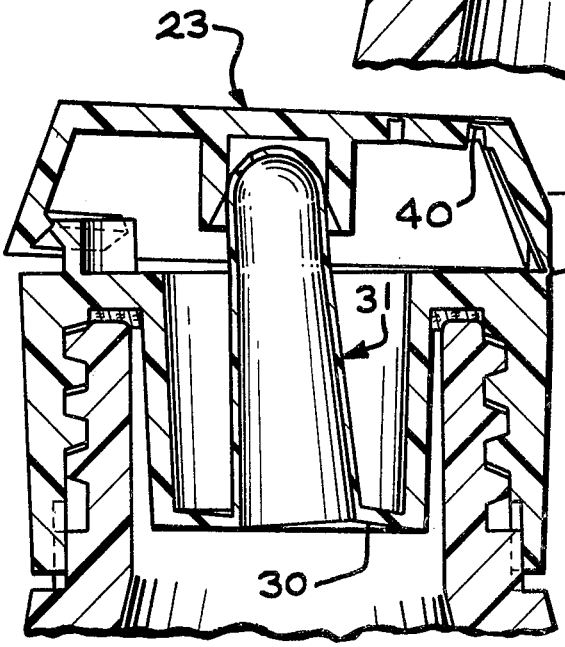
FIG. 7 is a view similar to FIGS. 4, 5, and 6, and showing the closure in an intermediate position between the open position of FIG. 4 and the closed position of FIG. 5.

As can best be seen by reference to FIG. 7, when the lid 23 is moved toward closed position illustrated in FIGS. 1 and 5, engagement between the lip 42 and rib 43 pulls the lid 23 over (to the left in FIG. 7), flexing the hinge 24 at the web 39 and the flexible portion 40. Because the closing element 35 already has telescoped over the upper end of the nozzle 31, as shown in FIG. 7, the lateral movement of the lid 23 at this point also pulls over the upper end of the nozzle 33, flexing either the nozzle 33 or the lower web 30, or both.

Immediately thereafter the lid 23 is moved downwardly its last increment of arcuate movement to the closed position of FIGS. 1 and 5, the resiliency of the nozzle 31, web 30, and hinge 24 pulling the lid 23 back (to the right in FIG. 7) snapping the rib 43 beneath the lip 42, to the position illustrated in FIG. 5.

It will be appreciated, of course, that in order for the just described actions to occur when the lid 23 is moved from its fully open position of FIGS. 3 and 4 to its fully closed position of FIGS. 1 and 5, the material from which the closure is fabricated must be a resilient material, for example, polyethylene or the like.

The rib 43 and lip 42 function as a child-resistant catch means to retain the lid 23 in the closed position of FIGS. 1 and 5, and, as can be seen in those figures, the outside circumference of the lower margin of the lid rim 34 and the hinge web 36 are such that they are no larger than, and preferably the same size as, the diameter and circumference of the outer edge of the cap top web 29. The coincidence of the edges of the lid 23 and the cap 24 thus disguises the functioning described above and also practically eliminates the possibility that one can open a closure embodying the invention merely by swinging the lid 23 from from the closed position to the open, or dispensing, position.

Because of the telescoping engagement of the upper end of the nozzle 31 and the closing element 35 and the resiliency of the material from which these parts are fabricated, the lid 23 is snugly retained in its closed position by the engagement of the catch means 42 and 43, as described.

In addition, because there are no parts of the cap 22 or the lid 23 which protrude radially beyond the common periphery of the edges thereof, the closure readily can be handled by conventional automatic capping machinery.

Figure 6:
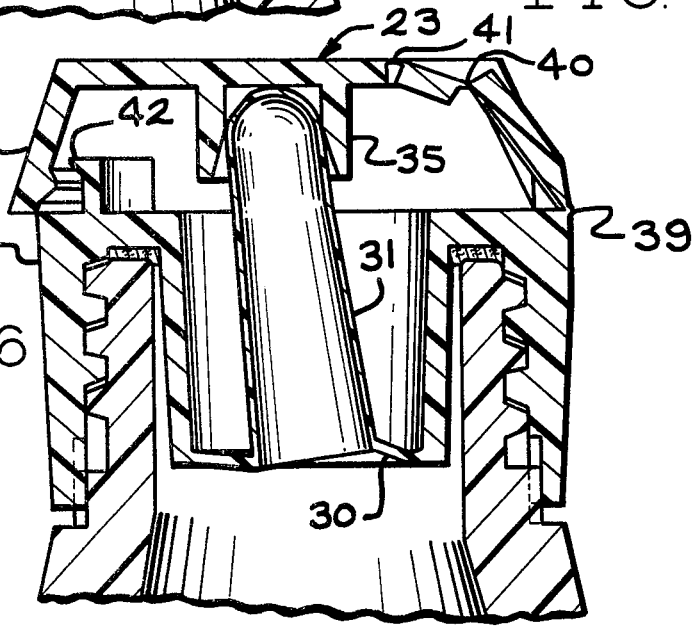
FIG. 6 is a view similar to FIGS. 4 and 5, and showing the closure in the same position as that illustrated in FIG. 2.

When an older child or an adult desires to dispense material from the container, it is necessary that two simultaneous dissimilar actions be performed. First, the person must push the lid 23 from the position illustrated in FIGS. 1 and 5 to the position illustrated in FIGS. 2 and 6. This is made possible by the flexing of the double-acting hinge 24 on the web 39 and flexible portions 40 and 41 as illustrated in FIG. 6 and is resisted by the resiliency of those hinge elements as well as the resiliency of the nozzle 31 and/or the lower web 30. This action is necessary in order to move the rib 43 on the lid 23 outwardly relative to the lip 42. As can be seen in FIG. 6, this causes the edge of the lid rim 34 to protrude laterally beyond the upper edge of the outer cap skirt 25 so that it can be engaged by the finger of the user. The user may then swing the lid upwardly and around the hinge web 39 to the open position of FIGS. 3 and 4.

However, if the lateral pressure on the lid 23 against the resiliency of the several elements is released before the now-protruding edge of the cap rim 34 is engaged, the lid simply snaps back to the closed position illustrated in FIGS. 1 and 5.

It is this requirement for simultaneous, dissimilar actions and the continuing necessity to hold the lid 23 in its laterally displaced position against the resiliency of the parts as described before it can be swung to the open position, which renders the cap strongly child-resistant. Indeed, the degree of resistance to the lateral movement of the lid 23 relative to the cap 22 and thus the degree of child-resistance may be modified as desired simply by stiffening the material from which the cap 22 and lid 23 are molded, either by selection of the particular compound or by different thicknesses of the various sections of the molded parts.

Figure 9:
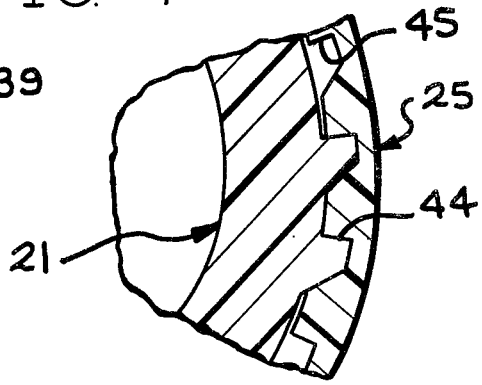
FIG. 9 is a fragmentary, horizontal, sectional view taken along the line 9—9 of FIG. 4 and shown on an enlarged scale.

In addition, in this embodiment of the invention, means are provided to positively retain the entire closure 20 on the neck of the container 21. These means consist of cooperating one-way ratchet teeth 44 on the neck of the container 21 and 45 on the outer skirt 25 of the cap 20, as shown in FIG. 9.

In the particular embodiment of the invention illustrated in FIGS. 1–9, inclusive, it will be noted that the dispensing orifice 32 is not centered at the top of the nozzle 31, but is inclined at an angle of 45°, more or less, so that when the material is dispensed through a closure embodying the invention, it can be directed upwardly or laterally. This is particularly useful when materials, such as toilet bowl cleaner, are packaged in containers having closures embodying the invention. For other materials, the dispensing orifice may be located at the peak of the nozzle 31 and it may be of such size as is desired for that particular material.

FIGS. 10–12

Figure 10:
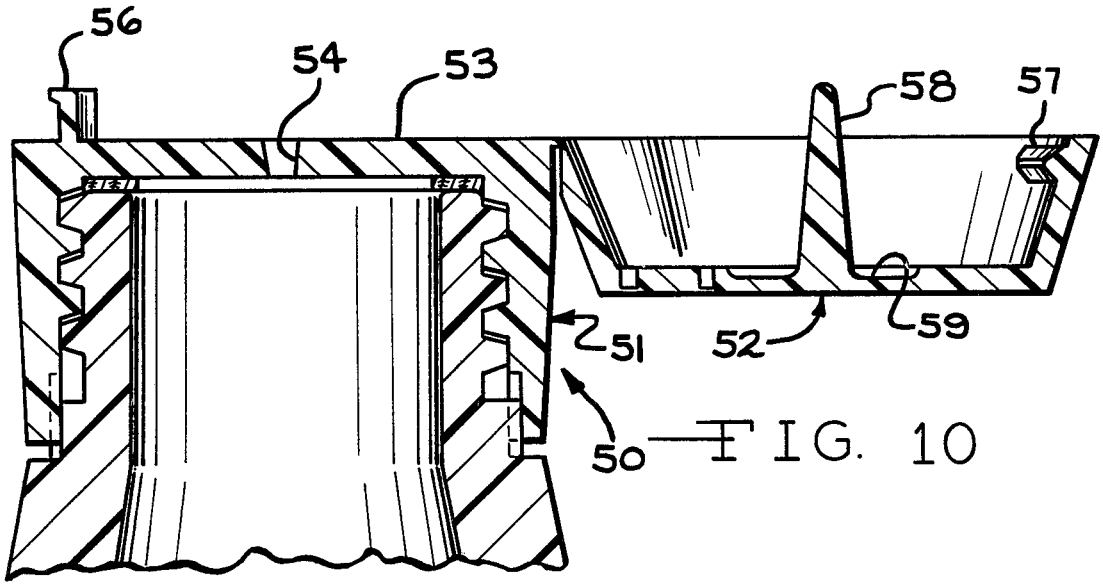
FIG. 10 is a vertical, sectional view similar to FIG. 4, showing a second embodiment of the invention also in open position.
Figure 11:
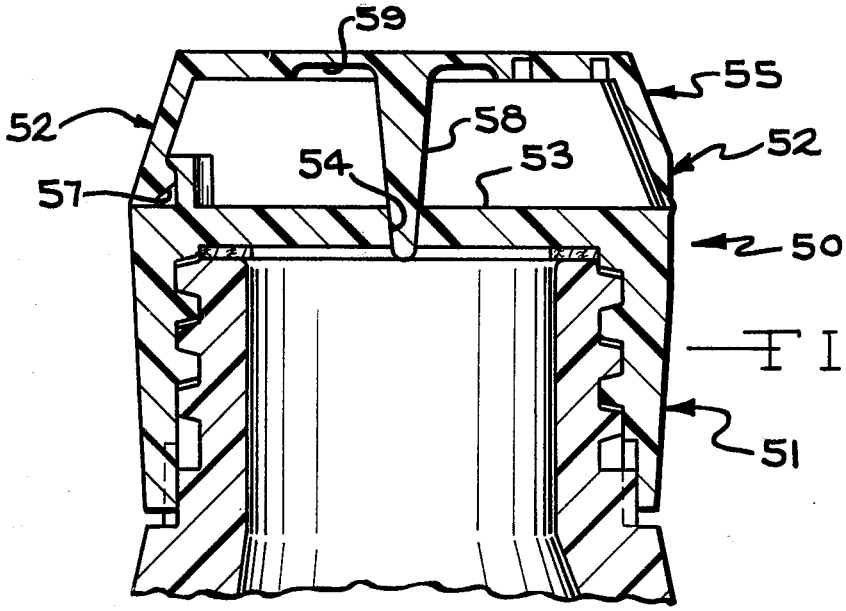
FIG. 11 is a vertical, sectional view showing the embodiment of FIG. 10 in closed position.
Figure 12:
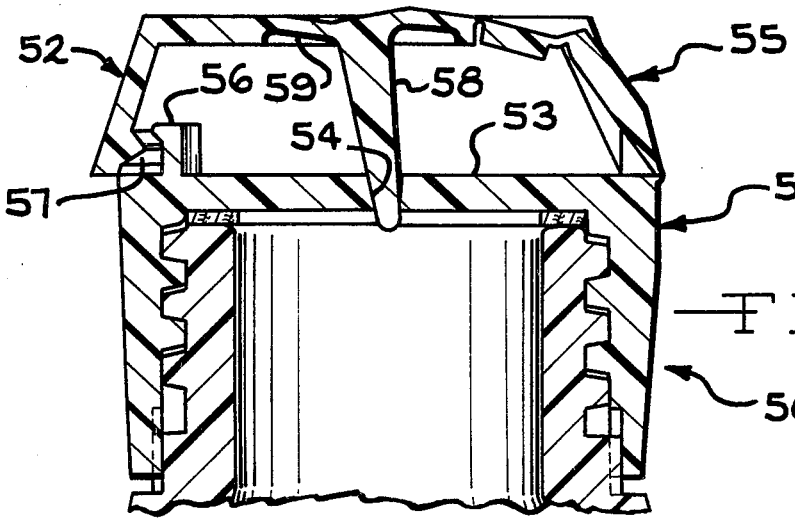
FIG. 12 is a view comparable to FIG. 6 showing the embodiment of FIG. 10 in closed position.

FIGS. 10, 11, and 12 show a second embodiment of the invention in which a closure 50, like the earlier described embodiment, consists of a threaded cap 51 and a lid 52 which is integral therewith. In this embodiment, however, the cap 51 has a generally disc-like top 53 in which there is molded a central dispensing orifice 54. A double-acting hinge 55 connects the lid 52 to the cap 51 and the cap 51 and lid 52 are provided with catch means 56 and 57, respectively, as in the earlier embodiment. In this structure, the lid 52 has a stopper 58 formed on the under-surface of the top of the lid 52, the base of the stopper 58 blending into a thinner portion 59 of the lid 52. As can be seen in FIG. 11, in closed position of this embodiment, the stopper 58 extends into the orifice 54.

As is illustrated in FIG. 12, when it is desired to open the closure 50, the lid 52 is pushed laterally relative to the cap 51 to which it is integrally connected by the hinge 55. This flexes the hinge 55 in the manner previously described. In this embodiment, because the stopper 58 is engaged in the dispensing orifice 54, lateral movement of the lid 52 flexes the thinner portion 59 of the lid top and resiliently resists the lateral movement in the same fashion as the resistance to such movement is provided by the structure illustrated in FIGS. 1–9. Again, it is first necessary to shift the lid 52 laterally and, while holding it in laterally-shifted position against the resiliency of the structural elements, to catch its lower protruding edge at the side opposite the hinge 55 in order to swing it upwardly to the open position of FIG. 10.

FIGS. 13–14

Figure 13:
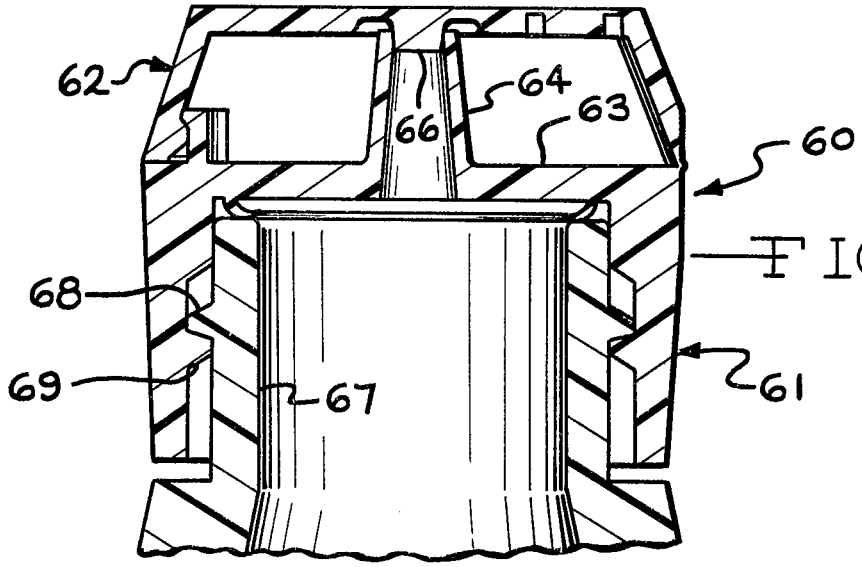
FIG. 13 is a vertical, sectional view of a third embodiment of the invention in closed position.
Figure 14:
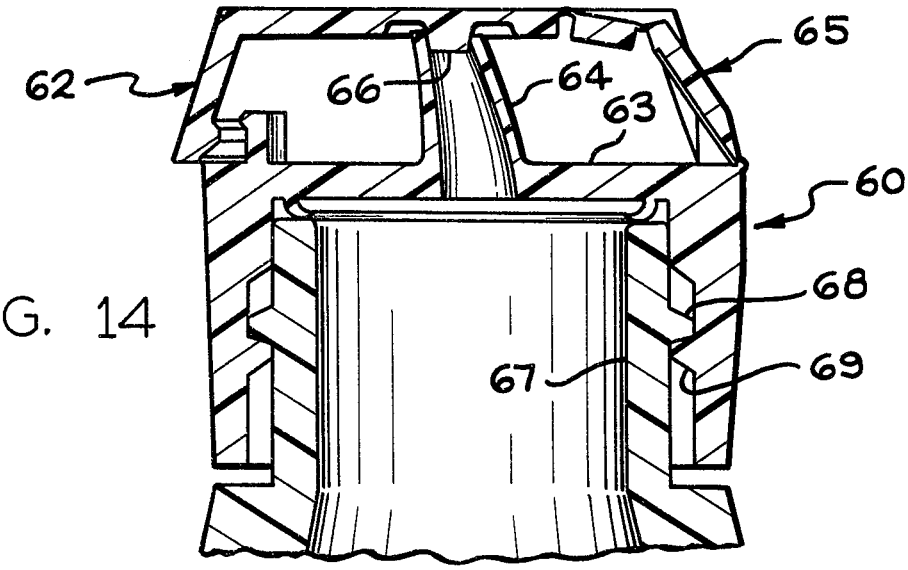
FIG. 14 is a view of the embodiment of FIG. 13 comparable to FIGS. 6 and 2.

FIGS. 13 and 14 show a closure 60 consisting of a cap 61 and a lid 62. In this embodiment, the cap 61 has a top 63 with a protruding nozzle 64 which defines a discharge orifice. In common with the earlier embodiments, the cap 61 and lid 62 are integrally connected by a double-acting hinge 65. The hinge 65 provides not only for swinging movement between a fully open position and the closed position illustrated in FIG. 13, but also for the lateral movement illustrated in FIG. 14.

A short nozzle plug 66 is molded on the under-surface of the top of the lid 62 and is of such size as to fit into the open end of the nozzle 64 in the closed position illustrated in FIG. 13. Thus, as best illustrated in FIG. 14, when the lid 62 is laterally moved to disengage the lid 62 in order that the closure may be opened, the resiliency of the nozzle 64 resists this movement in the same manner in which the comparable flexible members of the embodiments of FIGS. 1–9 and FIGS. 10–12 function.

In contrast to the embodiments of FIGS. 1–9 and 10–12, the embodiment of FIGS. 13 and 14 is retained on the end of a container neck 67 by over-lapping, annular rings 68 on the exterior of the neck 67 and 69 formed on the interior wall of the cap 61.

FIG. 15

Figure 15:
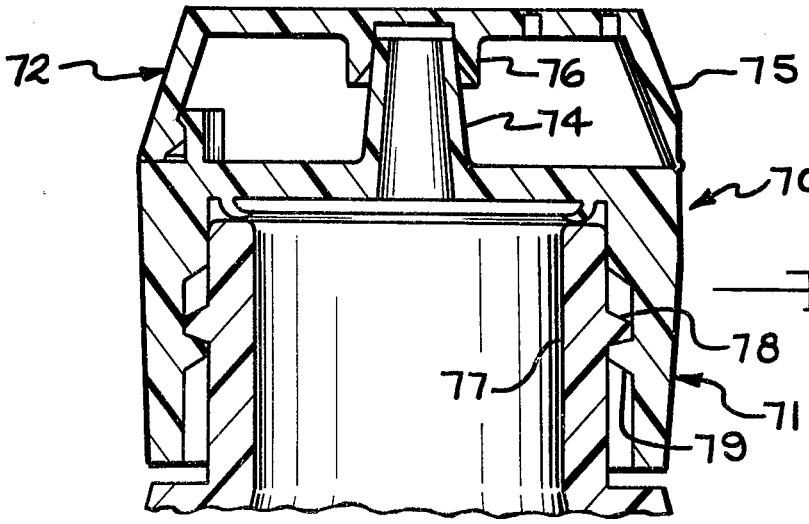
FIG. 15 is a view similar to FIG. 13 of a fourth embodiment of the invention.

The embodiment illustrated in FIG. 15 is very similar to that of FIGS. 13–14. A closure 70 consists of a cap 71 and a lid 72. The cap 71 has a top 73 and an integral, protruding nozzle 74 which provides a discharge orifice. The cap 71 and lid 72 are connected by an integral hinge 75.

In this embodiment a closing element 76 is molded on the underside of the top of the lid 75 and fits circumjacent the end of the nozzle 74 in the same manner as the cup-shaped closing element 35 of FIGS. 1–9.

In common with the embodiment of FIGS. 13–14, the closure 70 is retained on a container neck 77 by interengaged rings 78 on the exterior of the container neck 77 and 79 on the inner surface of the cap 71.

FIGS. 16–18

A closure 80 consists of a cap 81 and a lid 82 similar to those previously described. As in earlier embodiments, the cap 81 has a top 83 and a protruding nozzle 84 which defines a discharge opening. The cap 81 and lid 82 are integrally connected by a relatively thin web of material which forms a hinge 85. The hinge 85 of this embodiment differs from the hinges of earlier embodiments in that it does not have a number of parts with intervening thinner portions upon which it flexes, but, by reason of its thin section, provides for both the angular swinging motion and the lateral release movement, i.e., the movement from the closed position shown in FIG. 17 to the initial position illustrated in FIG. 18, which disengages the catch means. As in the embodiment of FIGS. 13–14, the lid 82 has an interior closing element 86 which enters the end of the nozzle 84 in closed position, and, as earlier described, this engagement provides the resilient resistance to the movement from the position of FIG. 17 to the position of FIG. 18.

The embodiment of FIGS. 16–18 (see particularly FIG. 16) is retained on a container neck 87 by interengaging rings 88 and 89, as is the case with respect to the embodiment of FIGS. 13–14 and 15.

It will be noted that the particular means by which a closure is retained on the neck of a container does not, in itself, constitute a part of the instant invention, inasmuch as interengaging threads or interengaging rings are well-known conventional means for doing so.

Having described my invention, I claim:

1. A child-resistant dispensing closure for a container, said closure and said container having means for retaining said closure on said container, said closure consisting of (a) a cup-shaped body consisting of an annular skirt and a generally disc-shaped top, (b) means providing a central dispensing opening in said top, (c) a generally saucer-shaped lid having means on its underside that is adapted to close said dispensing opening when said lid is in closing position closely overlying said top, said lid being of such size and shape that no part of said lid over-hangs said top of said body in such position, (d) a flexible hinge web connecting said lid to said body at adjacent edges thereof, said web having a length sufficient to provide for (1) angular movement of said lid relative to said body from such closing position with said closing means closing said opening providing means and (2) lateral translatory movement relative to said body from such closing position a distance sufficient that the lower edge of said lid over-hangs the edge of said top of said body, and (e) co-operating child-resistant catch means on said lid and said body consisting of horizontal lips on said body and on said lid which are engaged when said lid is in such closing position overlying said body and which are disengagable by engaging the over-hanging edge of said lid after moving said lid from such closing position laterally relative to said body.

2. A child-resistant dispensing closure according to claim 1 in which the means for retaining said closure on the container comprises threads on said closure which mate with threads on said container.

3. A child-resistant dispensing closure according to claim 2 and inter-engaging means on said closure and the container which resist rotation of said closure relative to said container.

4. A child-resistant dispensing closure according to claim 1 in which the closing means and the opening providing means are telescopingly engaged when the lid is in closing position thereby providing a bias against lateral movement of said lid relative to the body.

5. A child-resistant dispensing closure according to claim 1 in which the means providing a central dispensing opening is a nozzle having a dispensing orifice in its upper end and which constitutes an integral part of the top of the body and the closing means is an element on the under side of the lid which telescopes with the upper end of said nozzle.

6. A child-resistant dispensing closure according to claim 1 in which the catch means consists of:

(a) at least one over-hanging lip on the top of the body, and (b) a lip on the margin of the lid that is adapted to engage beneath said over-hanging lip for retaining said lid in closing position,

7. A child-resistant dispensing closure according to claim 1 in which the lid has a circular disc-like top and a rim having a major diameter no greater than the diameter of the top of the closure to which it is adjacent in closing position.

8. A child-resistant dispensing closure according to claim 7 in which a portion of the integral hinge is recessed into the rim of the saucer-shaped lid.

9. A child-resistant dispensing closure according to claim 7 in which the hinge web has a first flex line at the connection to the body and a second flex line spaced from the first said flex line and at the connection to the lid.

10. A child-resistant dispensing closure for a container, said closure and said container having co-operating means for retaining said closure on said container, said closure comprising in combination, (a) a cup-shaped body having a generally disc-shaped top, (b) a central dispensing opening in said top, (c) a generally saucer-shaped lid, said lid having means adapted to close said dispensing opening when in closing position atop said body and having a lateral dimension no greater than the dimension of said top, (d) a double-acting, flexible hinge web connected to said lid and to said body at adjacent edges thereof, said hinge web having a length sufficient for providing translatory movement of said lid relative to said body a distance sufficient for the edge of said lid to over-hang the edge of said top of said body and also providing for movement of said lid angularly from a position atop said body, and (e) catch means on said body consisting of at least one pair of lips on the top of said body and said lid which are adapted to engage for preventing such angular movement when said lid is in closing position, whereby said lid, first, must be moved laterally for protruding the edge of said lid beyond the edge of the top of said body and, second, swung angularly on said hinge web for removing said closing means from said dispensing opening.

11. A child-resistant closure according to any of claims 1 or 10 in which the dispensing opening is directed angularly relative to the axis of the closure.

12. A child-resistant closure according to any of claims 1 or 10 in which the hinge web has at least three flex lines.

* * * * *